US006265629B1

(12) United States Patent
Fava et al.

(10) Patent No.: US 6,265,629 B1
(45) Date of Patent: Jul. 24, 2001

(54) FUEL OIL COMPOSITIONS

(75) Inventors: Carlos S Fava; Rinaldo Caprotti, both of Oxford (GB)

(73) Assignee: Exxon Chemical Patents INC, Linden, NJ (US)

( * ) Notice: Subject to any disclaimer, the term of this patent is extended or adjusted under 35 U.S.C. 154(b) by 0 days.

(21) Appl. No.: 08/894,889

(22) PCT Filed: Mar. 2, 1996

(86) PCT No.: PCT/EP96/00854

§ 371 Date: Sep. 17, 1997

§ 102(e) Date: Sep. 17, 1997

(87) PCT Pub. No.: WO96/26994

PCT Pub. Date: Sep. 6, 1996

(30) Foreign Application Priority Data

Mar. 2, 1995 (GB) ..... 9504222

(51) Int. Cl.[7] ..... C10L 1/08; C10L 1/16
(52) U.S. Cl. ..... 585/14; 44/388
(58) Field of Search ..... 44/388; 585/14

(56) References Cited

U.S. PATENT DOCUMENTS

| | | | | |
|---|---|---|---|---|
| 2,993,773 | * | 7/1961 | Stromberg | 44/398 |
| 3,273,981 | * | 9/1966 | Furey | 44/389 |
| 4,396,400 | * | 8/1983 | Grangette et al. | 44/301 |
| 4,604,188 | * | 8/1986 | Yan et al. | 44/301 |

FOREIGN PATENT DOCUMENTS

17160 * 4/1994 (WO) .

* cited by examiner

*Primary Examiner*—Margaret Medley

(57) ABSTRACT

The lubricity of low sulfur content middle distillate fuel oil boiling over a temperature range of 100°C. to 500°C. is enhanced by incorporation of a heavy fuel component having hydrocarbon components resulting from distillation of a crude oil, whereby the incorporation of the heavy fuel component increases at least one of (a) the 50% distillation temperature, and (b) the polynuclear aromatic content of the composition, and wherein the composition gives a wear scar diameter, as measured by the HFRR test at 60°C., of at most 500 $\mu$m.

3 Claims, No Drawings

FUEL OIL COMPOSITIONS

This application is a 371 of PCT/EP96/00854 dated Mar. 02, 1996.

This invention relates to fuel oils, and to the use of additives to improve the characteristics of fuel oils, more especially of diesel fuel and kerosene.

Environmental concerns have led to a need for fuels with reduced sulphur content, especially diesel fuel and kerosene. However, the refining processes that produce fuels with low sulphur contents also result in a product of lower viscosity and a lower content of other components in the fuel that contribute to its lubricity, for example, polycyclic aromatics and polar compounds. Furthermore, sulphur-containing compounds in general are regarded as providing anti-wear properties and a result of the reduction in their proportions, together with the reduction in proportions of other components providing lubricity, has been an increase in reported sudden failures of fuel pumps in diesel engines using low sulphur fuels, the failure being caused by wear in, for example, can plates, rollers, spindles and drive shafts.

This problem may be expected to become worse in future because, in order to meet stricter requirements on exhaust emissions generally, high pressure fuel pumps, including in-line, rotary and unit injector systems, are being introduced, these being expected to have more stringent lubricity requirements than present equipment, at the same time as lower sulphur levels in fuels become more widely required.

At present, a typical sulphur content in a diesel fuel is about 0.25% by weight. In Europe maximum sulphur levels are being reduced to 0.20%, and are expected to be reduced to 0.05%; in Sweden grades of fuel with levels below 0.005% (Class 2) and 0.001% (Class 1) are already being introduced. A fuel oil with a sulphur level below 0.20% by weight is referred to herein as a low-sulphur fuel.

The present invention is based on the observation that the addition of a proportion of a heavy fuel component enhances the lubricity of a low-sulphur fuel while retaining acceptable low temperature properties. GB 1,264,684 describes middle distillate fuel oils whose response to certain copolymer flow improvers is improved by incorporation therein of about 0.4 to about 20 weight percent of a paraffinic distillate fraction boiling within the range of about 450 and 950° F. (232 and 510° C.) and containing certain paraffinic hydrocarbons.

In a first aspect of the invention, there is provided the use of a heavy fuel component to enhance the lubricity of a fuel oil composition having a sulphur content of at most 0.2% by weight, more especially of at most 0.05% by weight.

In a second aspect of the invention, there is provided a process for the manufacture of a middle distillate fuel oil of enhanced lubricity, which comprises refining a crude oil to produce a middle distillate fuel oil of low sulphur content, and blending a heavy fuel component with the refined product to provide a fuel oil composition with a sulphur content of at most 0.2% by weight, preferably of at most 0.05% by weight.

In a third aspect of the invention, there is provided a diesel fuel composition comprising a diesel fuel and a heavy fuel component present in a proportion of from 25% to 50% by weight, based on the weight of diesel fuel, the sulphur content of the composition being at most 0.2% by weight (based on the weight of the composition). Advantageously, the sulphur content is at most 0.05% by weight.

Advantageously, the composition of the third aspect, and the composition resulting from the use of the first aspect, and the composition resulting from the process of the second aspect of the invention, have a lubricity such as to give a wear scar diameter, as measured by the HFRR test (as hereinafter defined) at 60° C. of at most 500 $\mu$m.

As used herein, the term "middle distillate" refers to fuel oils obtainable in refining crude oil as the fraction from the lighter, kerosene or jet fuel, fraction to the heavy fuel oil fraction. The fuel oils may also comprise atmospheric or vacuum distillate, cracked gas oil or a blend, in any proportions, of straight run and thermally and/or catalytically cracked distillate. Examples include kerosene, jet fuel, diesel fuel, heating oil, visbroken gas oil, light cycle oil, vacuum gas oil, light fuel oil and fuel oil. Such middle distillate fuel oils usually boil over a temperature range, generally within the range of 100° C. to 500° C. as measured according to ASTM D86, more especially between 150° C. and 400° C.

The preferred middle distillate fuel oil is diesel fuel.

As examples of heavy fuel component there may be mentioned components from an atmospheric distillation stream, a vacuum distillation stream, a conversion stream, e.g., from a fluid catalytic or thermal cracking, visbreaking, or coking unit, or a vegetable-based fuel oil, especially a transesterified vegetable oil, e.g., rapeseed methyl ester. In general, a component is a heavy fuel component if its inclusion in a middle distillate fuel oil, e.g., an automotive diesel fuel, increases one or both of the following: 50% distillation temperature (as defined in ASTM D 86) and polynuclear aromatic content, especially the content of aromatics containing three or more rings.

In the first and second aspects of the invention, the heavy fuel component is advantageously employed in a proportion up to 50%, preferably from 0.01% to 40%, most preferably from 0.5% to 30%, by weight, based on the weight of the low sulphur fuel. Advantageously, the heavy fuel component is employed in a proportion of at least 25% by weight. The heavy fuel component may itself be a low sulphur fuel.

In a third aspect of the invention, the heavy fuel component is preferably employed in a proportion of 30 to 40% by weight.

The HFRR, or High Frequency Reciprocating Rig, test is that given in C.E.C.F-06-T-94 and ISO TC22/SC7/WG6N180.

The fuel oil compositions defined under any aspect of the invention may contain additives, for example cold flow improvers.

As used herein, the term "cold flow improver" refers to any additive which will lower the pour point, the cloud point, the wax appearance temperature, the cold filter plugging point (hereinafter CFPP) of a fuel, or will reduce the extent of wax settlement in a fuel, especially a middle distillate fuel.

Numerous classes of flow improvers, especially middle distillate flow improvers, are suitable for use.

The fuel oil compositions may contain one or more other additives such as known in the art, for example the following: detergents, antioxidants, corrosion inhibitors, dehazers, demulsifiers, antifoaming agents, cetane improvers, cosolvents, package compatibilizers, and lubricity additives.

The following Example, in which parts and percentages are by weight unless indicated otherwise, illustrates the invention:

In the example, the HFRR test was carried out under the following conditions:

| | |
|---|---|
| LOAD | 2N |
| STROKE | 1 mm (0.5 mm AMPLITUDE) |
| FREQUENCY | 50 Hz |
| TEMPERATURE | 25 and 60° C. |
| METALLURGY | BALL ANSI 52 100 (hardened bearing tool steel) 645 HV 30<br>FLAT ANSI 52 100 (bearing tool steel) 180 HV 30 |
| SURFACE FINISH | 0.1 $\mu$M Ra (BALL AND FLAT) |
| DURATION | 75 minutes |

EXAMPLE

Lubricity tests were carried out at 60° C. on a Class 1 diesel fuel, sulphur content 0.00045% (4.5 ppm), IBP 176° C., FBP 294° C., 90%–20% 56° C., CFPP–37° C. The heavy fuel component was a heavy gas oil, IBF 199° C., FBP 481° C., 90%–20% 105° C., cloud point 25° C.

The results of the HFRR test were as follows:

| Composition | Heavy Component % | Cold Flow Additive | Wear, $\mu$m | Friction |
|---|---|---|---|---|
| 1 | 0 | — | 648 | 0.72 |
| 2 | 5 | — | 615 | 0.33 |
| 3 | 15 | — | 322 | 0.18 |
| 4 | 30 | — | 341 | 0.18 |

The results show that the heavy fuel component, here a heavy gas oil, has beneficial results on the fuel lubricity.

What is claimed is:

1. A process for enhancing the lubricity of a diesel fuel oil composition having a sulfur content of at most 0.2% by weight, the process comprising adding to a diesel fuel oil obtainable from a refined crude oil as the fraction from the lighter fraction to the heavy oil fraction and boiling over a temperature within the range of 100° C. to 500° C., as measured according to ASTM D86, 0.01% to 40% by weight of a heavy gas oil component having hydrocarbon components resulting from an atmospheric distillation stream, a vacuum distillation stream or a conversion stream, the heavy gas oil component, when added to the diesel fuel oil, increases at least one of (a) 50% distillation temperature as defined in ASTM D86 and (b) the polynuclear aromatic content and wherein the lubricity of the diesel fuel oil composition is such as to give a wear scar diameter, as measured by the HFRR test at 60° C. of at most 500 $\mu$m.

2. The process according to claim 1 wherein the diesel fuel oil composition has a sulfur content of at most 0.05% by weight.

3. The process according to claim 2 wherein the heavy gas oil component is present in the composition in an amount of from 0.5% to 30% by weight.

* * * * *

UNITED STATES PATENT AND TRADEMARK OFFICE

CERTIFICATE OF CORRECTION

PATENT NO. : 6,265,629 B1
DATED : July 24, 2001
INVENTOR(S) : C.S. Fava and R. Caprotti It is certified that error appears in the above-identified patent and that said Letters Patent is hereby corrected as shown below:

Column 4,
Line 24, delete "2" and insert -- 1 --.

Signed and Sealed this

Fourteenth Day of May, 2002

*Attest:*

*Attesting Officer*

JAMES E. ROGAN
*Director of the United States Patent and Trademark Office*